United States Patent [19]

Lunde

[11] 4,401,101

[45] Aug. 30, 1983

[54] WOOD-FIRED BOILER AND STORAGE SYSTEM

[76] Inventor: Martin R. Lunde, 2608 37th Ave. North, Minneapolis, Minn. 55421

[21] Appl. No.: 325,766

[22] Filed: Nov. 27, 1981

Related U.S. Application Data

[63] Continuation-in-part of Ser. No. 211,778, Dec. 1, 1980, abandoned.

[51] Int. Cl.[3] ..... F24B 9/00

[52] U.S. Cl. ..... 126/367; 126/368; 219/279; 237/65; 122/155 A

[58] Field of Search ..... 126/368, 367, 364, 365, 126/387, 389, 5, 54, 20, 21 A, 79, 103, 297, 132, 133, 61, 77, 360 R, 361, 347, 368, 15 A, 101, 91 R; 237/8 C, 8 B, 16, 56, 65, 74, 71, 70, 59; 219/329, 279; 431/344, 347; 122/13 A, 15, 22, 29, 50, 155 A, 33

[56] References Cited

U.S. PATENT DOCUMENTS

| | | | |
|---|---|---|---|
| 367,209 | 7/1887 | Just | 126/367 |
| 428,702 | 5/1890 | Stowell | 126/368 |
| 567,034 | 9/1896 | Loy | 126/61 |
| 1,119,195 | 12/1914 | Schuck | 126/368 |
| 1,189,806 | 7/1916 | Gibson | 237/8 B |
| 1,383,530 | 7/1921 | Cotton | 126/347 |
| 1,688,092 | 10/1928 | Smith | 126/35 |
| 2,067,133 | 1/1937 | Wales | 122/155 A |
| 2,355,417 | 8/1944 | Breese | 126/15 A |
| 2,601,264 | 6/1952 | Daugherty | 219/329 |
| 4,210,102 | 7/1980 | Dosmann | 126/101 X |

FOREIGN PATENT DOCUMENTS

| | | | |
|---|---|---|---|
| 3133 | 12/1825 | France | 126/365 |
| 50248 | 2/1932 | Norway | 237/16 |
| 159498 | 12/1931 | Switzerland | 219/279 |
| 637051 | 5/1950 | United Kingdom | 237/8 C |

OTHER PUBLICATIONS

"HTW Installations", *Air Conditioning, Heating and Ventilating,* Nov. 1962.

*Primary Examiner*—Samuel Scott
*Assistant Examiner*—Randall L. Green
*Attorney, Agent, or Firm*—Dorsey & Whitney

[57] ABSTRACT

A wood-fired boiler and hot liquid storage system includes a top-vented storage tank for the liquid, a firebox supported within the tank at a level for complete immersion within the liquid, with the bottom of the firebox spaced above the bottom of the tank, and with a firebox end opening in liquid tight engagement with the edges of a corresponding tank side wall opening, and a firebox door for selectively closing the opening and permitting introduction of solid fuel. Combustion gases from the firebox are discharged through an open vertical stack extending up through the tank and liquid to an outlet opening outside the tank. Preheated combustion air is introduced at the firebox opening and fed by forced draft through the firebox and stack by a blower. The preheating is provided by a special firebox door construction in which incoming air passes between inner and outer walls of the door and is preheated by the hot inner door wall while it also keeps the outer door wall at a lower temperature. Other features include selectively usable off-peak electrical immersion heating elements, cylindrical tank and firebox cross sections, and special heat transfer means in the firebox and stack construction details.

23 Claims, 8 Drawing Figures

WOOD-FIRED BOILER AND STORAGE SYSTEM

CROSS REFERENCE TO RELATED APPLICATION

This application is a continuation-in-part of my earlier copending application Ser. No. 06/211,778, filed Dec. 1, 1980 now abandoned.

BACKGROUND OF THE INVENTION

The invention relates to apparatus for heating of liquids and more particularly to such apparatus designed for the use of solid fuels such as wood, coal, peat, hay or other chunk fuels.

Many devices have been proposed for deriving heat from the burning of solid-type fuels and for using the thermal energy derived from such combustion to heat room spaces, liquids, or other elements. Wood burning stoves, for example, have been equipped with liquid-containing coils or tanks in order to utilize the stove heat for the further heating of water for domestic use.

In some of these prior cases, the heating of liquid is merely an auxiliary function of a wood or coal burning unit which is primarily intended for other uses, such as cooking. In other cases, the solid-fuel-burning unit has been incorporated in a boiler to heat liquid under pressure for the generation of steam or for transmission of such heated liquid to other locations for storage or immediate use.

Pressurized boilers or tanks must meet minimum code standards requiring such safety devices as pressure relief valves. The fireboxes of such solid-fuel-burning units also reach such temperatures that special insulation must be provided, or the units must be isolated from wooden or inflammable structures such as buildings, with construction code limitations as to the necessary spacing of the heated portions of such units from the walls or other portions of any building in which such a unit is located or any structures adjacent to such units.

SUMMARY OF THE INVENTION

The present invention provides an improved solid-fuel-burning liquid heater in which a firebox is combined within a liquid storage tank having tank wall portions for containing a desired volume of liquid to be heated and stored. A side wall portion of such tank has a single opening space above the bottom tank wall portion, and a water-tight firebox is located within the tank and has one open end in liquid-tight engagement with the tank wall portion around the firebox opening. The firebox also has a main body portion with top, bottom and side firebox wall portions and a firebox end wall portion opposite the open end, and the firebox is supported at a level within the tank for substantially complete immersion within the liquid to be heated and stored within the tank. For this purpose the bottom wall portion of the firebox is spaced upwardly from the bottom tank wall portion and the opposite or inner firebox end wall is spaced inwardly from the tank side wall portion opposite the firebox opening. An open stack member extends upwardly from the firebox through the liquid within the tank, the stack member having an inlet opening communicating with the interior of the firebox and an outlet opening outside of the tank for discharging gaseous combustion products from the firebox.

The top of the tank is vented at all times to permit overflow of excess liquid and venting of water vapor or steam to the atmosphere.

The preferred embodiments of the invention include special design and construction features, such as baffle means in at least one of the firebox and stack members to enhance the transfer of heat from the gaseous combustion products to the firebox and stack walls and thus to the surrounding liquid within the tank. Efficiency of combustion, (i.e., low pollution production) and maximization of heat output are enhanced by the addition of a forced draft through the firebox and stack, and a special fire door construction is provided for the open end of the firebox to introduce the necessary airflow into the firebox at an optimum location and direction, and to provide for simultaneous preheating of such air and cooling of the outer surface of such door.

Other features of the invention will be apparent from the following further description.

BRIEF DESCRIPTION OF THE DRAWINGS

In the drawings which form a part of this application, and in which like reference characters indicate like parts.

DESCRIPTION OF THE PREFERRED EMBODIMENTS

Figure 1:
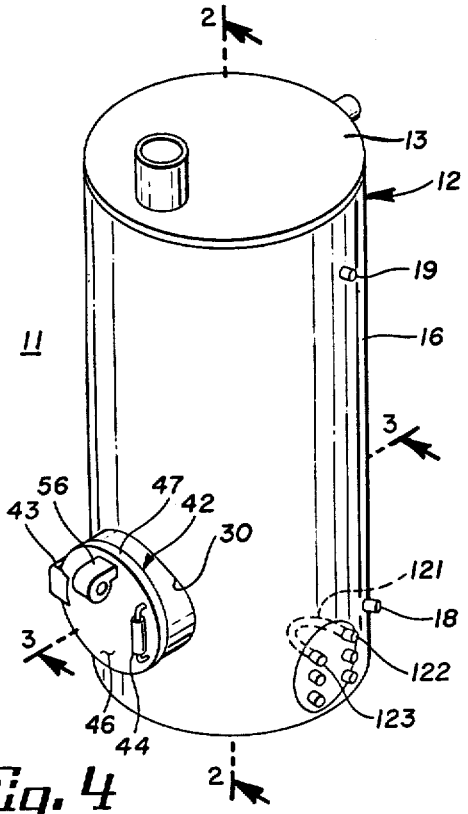
FIG. 1 is a perspective view of one form of liquid heating and storage apparatus according to the invention.
Figure 2:
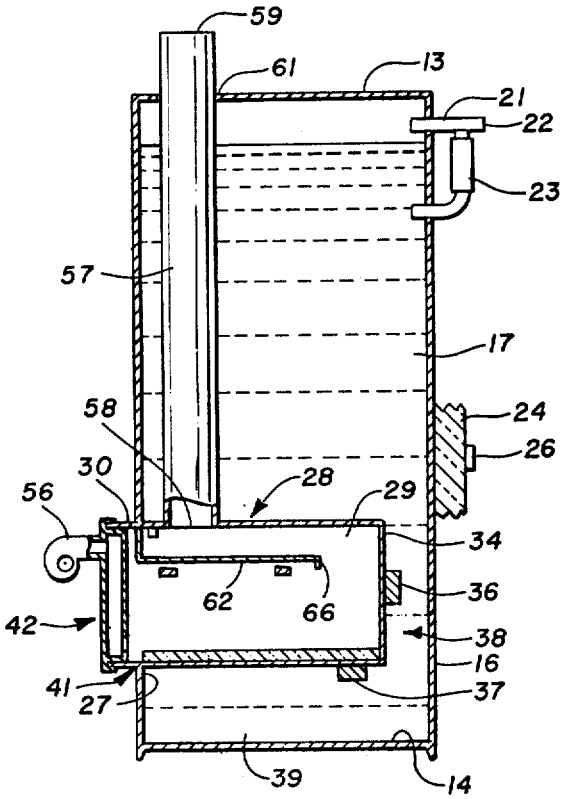
FIG. 2 is a partial sectional view on the line 2—2 of FIG. 1.
Figure 4:
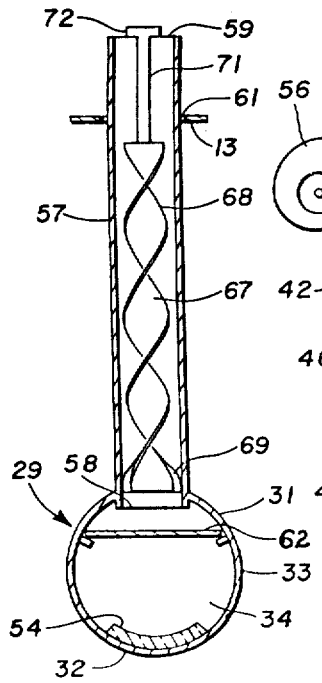
FIG. 4 is a partial sectional view on the line 4—4 of FIG. 3.
Figure 3:
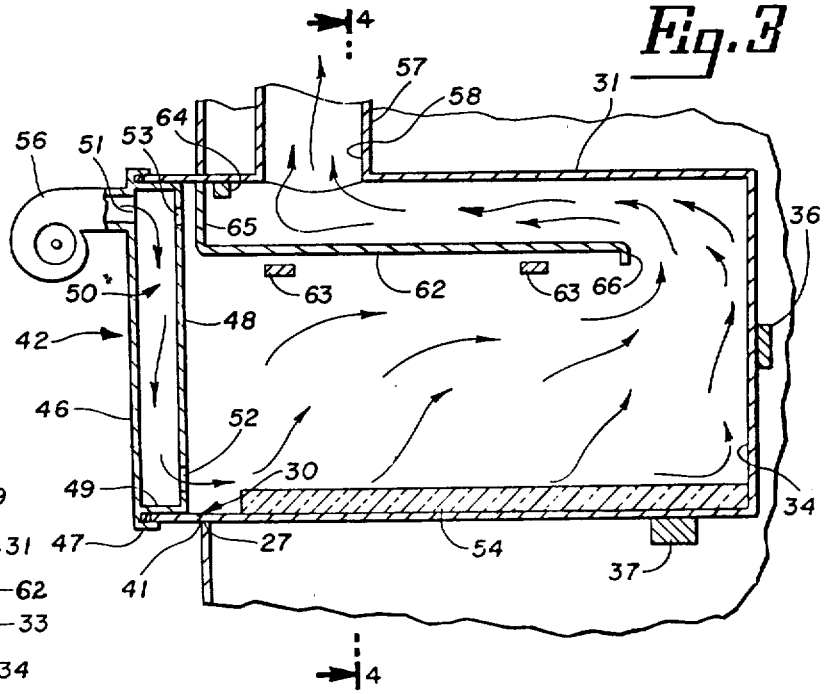
FIG. 3 is an enlarged partial sectional view of the firebox portion of FIG. 2 on the line 3—3 of FIG. 1.

One embodiment of a liquid heating and storage apparatus according to the present invention is indicated generally at 11 in FIGS. 1 and 2, with further details shown in FIGS. 3 and 4. The apparatus 11 includes a storage tank 12 of substantial capacity for containing the liquid to be heated and stored therein. Although the present apparatus is designed for heating and storing water, the principles involved can be applied to the heating of other liquids of appropriate boiling point or other characteristics suitable for heating by the burning of solid fuels as contemplated herein.

Tank 12 includes top and bottom wall portions 13 and 14 and a side wall portion 16. The preferred construction involves a main body or side wall portion 16 which is cylindrical, in combination with flat circular top and bottom walls. Such a tank can be economically and efficiently manufactured and assembled using welded sheet steel elements, and the cylindrical side wall portion provides an efficient distribution of the forces and stresses involved in containment of a large and heavy volume of liquid 17 within the tank. An inlet 18 for supplying and replenishing the liquid within the tank is located at a lower portion of the side wall 16. An outlet 19 for withdrawing the heated water stored in the tank is positioned near the top of the tank. Appropriate controls of known construction can be used to maintain the desired liquid level within the tank, or such level may be reestablished manually by means of a valve (not shown) on inlet line 18, whenever the liquid level has dropped slightly within the upper portion of the tank so as to be just at or below the level of outlet 19.

The extreme upper portion of the tank is vented at all times to ambient atmospheric pressure by means of a vent pipe 21 having an open end 22. This vent and overflow pipe is designed with a sufficient diameter, relative to the expected liquid volume within the tank to make it unnecessary to provide pressure relief valves and related equipment as required by various pressurized boiler codes.

A sight glass 23 is combined with the vent pipe 21 for convenient observation of the specific liquid level at the upper end of the tank.

The present apparatus is designed for adequate storage of the heated liquid for desired intervals between intermittent burning of successive solid fuel loads in the firebox described below. Thus, the tank may be provided with outer insulation 24 and retaining members 26 to minimize the heat loss from the liquid stored in the tank.

The side wall portion 16 of the tank is provided with a single firebox opening 27 at a location spaced above the bottom tank wall 14. A firebox 28 for the combustion of solid fuel is positioned within tank 12 and has a body portion 29 with one open end 30 in liquid-tight engagement with the tank wall portion around the firebox opening 27. The firebox body portion also includes top and bottom wall portions 31, 32, side wall portion 33 and an inner end wall portion 34 opposite the open end 30.

As shown particularly in FIG. 4, the body portion 29 of the firebox is preferably of cylindrical cross section, so that the top, bottom and side wall portions 31, 32, 33 are parts of the common cylindrical body section.

The invention includes means supporting the firebox at a level within the tank for substantially complete immersion or envelopment of the firebox top, bottom, side and opposite end wall portions within and below the expected minimum operating level of liquid to be heated and stored within the tank. The firebox is positioned close to but spaced above the bottom tank wall. Supporting members 36 and 37 are shown for this purpose at the inner end of the firebox 28. Thus the end 34 of the firebox is separated from the sidewall portion 16 of tank 12 by liquid within the space 38 (FIG. 2). The bottom wall portion 32 of the firebox is similarly separated from the bottom tank wall 14 by liquid in the space 29. The open end 30 of the firebox 28 is supported by the edges of the firebox opening 27 in the tank wall, and a liquid-tight connection 41 is provided along the entire area of engagement of the firebox open end with the tank wall portion.

A firebox door or cover 42 is provided for the open firebox end 30 and may be supported on a hinge 43 and provided with an operating handle 44 for manual opening of the firebox to insert solid fuel therein. Firebox door 42 has a special construction which is particularly adapted for use in the present apparatus, but is also suitable for independent use with other solid fuel burning fireboxes for reasons discussed below. Door 42 has a double wall construction including an outer wall 46 with a flange 47 adapted to fit and seal the open end of the firebox. Door 42 also has an inner wall 48 spaced inwardly from outer wall 46 and closely fitting within the open end 30 of the firebox. A cylindrical connecting wall portion 49 between the outer and inner door walls 46, 48, provides an air space between such walls, as indicated at 50.

An air inlet opening 51 in the upper portion of the outer cover wall provides for introduction of combustion air to the space 50 between walls 46 and 48. An air discharge opening 52 at the lower portion of inner wall 48 serves as a discharge opening from air space 50 to direct the combustion air into the lower portion of firebox 28, i.e. against the base of the pile of solid fuel chunks (not shown) which would normally be positioned in the firebox body. A relatively smaller secondary air discharge opening 53 may be provided in the upper area of inner cover wall 48, to permit a limited flow of air to insure complete combustion of any unburned gases passing from the burning fuel in the base of the firebox.

A layer of firebrick 54 may be located above the bottom wall portion 32 of the firebox to support the solid fuel chunks and retain heat for promotion of better combustion in known manner.

A blower 56 is provided to deliver the desired rate of air flow through door inlet 51 and insure a forced draft of combustion air within the firebox.

The construction of firebox door 42 and its air space 50 provide a means of substantially preheating the combustion air by engagement with the hot inner cover wall 48 which is directly exposed to the heat of combustion within the firebox. It has been found that more efficient combustion can be achieved when the incoming air is preheated to a substantial extent, and the radiant heat from the burning fuel in the firebox maintains the inner cover wall 48 at a temperature adequate for such preheating.

At the same time, however, the double wall cover construction and its intermediate air space 50 effectively insulate the outer cover wall 46 from the direct heat of the burning fuel in the firebox. The cover temperature is accordingly maintained at a sufficiently low level to provide adequate safety for an operator and to avoid special requirements for fireproof construction or insulation of any nearby building portion with respect to the firebox door area of the present apparatus.

To remove the gaseous combustion products from the firebox, an open stack member has an inlet opening 58 at its lower end, communicating with the interior of the firebox. The stack extends upwardly from the firebox and has an open end 59 projecting upwardly through an opening 61 in the top wall 13 of the tank. The tank opening 61 is sufficiently larger than the external diameter of stack 57 to permit vertical relative expansion of the stack.

As shown particularly in FIG. 2, both the firebox 28 and stack 57 are substantially completely immersed in the liquid within tank 12. These elements are made of sheet steel or other highly heat conducting material, so that all surfaces of the firebox and stack, except for the firebox cover member itself, are in effective heat transfer relation with the liquid in the tank. This not only serves the purpose of achieving optimum transfer of heat from the burning solid fuel to the liquid, but also provides an important safety factor by limiting the external temperature of all portions of the tank to the maximum temperature of the liquid within the tank. Since the top of the tank is vented to atmosphere, the maximum temperature for water within the tank will be the boiling point of the water, i.e. 212° Fahrenheit at standard atmospheric pressure. The further provision of the double-walled firebox door with its insulating and preheating air space 50 further insures that all external surfaces of the present apparatus will be maintained at temperatures sufficiently low to avoid danger to immediately adjacent building wall members or other elements which might otherwise be subjected to a fire risk.

To improve the heating efficiency of the apparatus, at least one of the firebox and stack members, and preferably both such members, may be provided with means to optimize the heat transfer from within the firebox and stack to the liquid in the tank. For this purpose, the firebox includes a baffle member 62 extending horizontally across the upper portion of the firebox below the stack opening 58 from the vicinity of the firebox cover wall 48 toward the opposite end wall portion 34 of the firebox. The baffle member 62 is removably supported on members 63 for horizontal sliding removal when the cover 42 is open. A limiting stop 64 is engaged by upwardly extending flange 65 at the open end of the firebox to define the inner operating position of the baffle. A lip 66 at the inner end of the baffle is spaced from the end wall portion 34, and the gaseous combustion products must move from left to right (in FIG. 3) from the firebox door 52 against end wall portion 34, around the lip 66 of baffle 62 and back along the upper wall portion 31 of the firebox to the stack opening 58. Thus the hot gaseous products are directed against firebox wall portions 34 and 31 for increased efficiency of thermal transfer to the liquid within the tank.

At the same time, the baffle flange 65, in the event a secondary air opening 53 is provided in the upper portion of inner cover wall 48, directs such secondary air along the top of the burning fuel, without letting such air exhaust directly into stack opening 58.

To delay the exit of the hot gasses through stack 57, and to sweep such gaseous combustion products along the inner sides of the stack for increased effectiveness of heat exchange with the liquid in the tank, the stack is provided with a twisted baffle (turbulator) 67. This baffle member has a helical or spiral main body portion 68 with positioning flanges 69 at its lower end adapted to fit the interior diameter of the stack and provide the desired lateral positioning of the lower end of baffle 67. The upper end of baffle 67 is secured to an upper support member 71 having a suitable supporting flange 72 for suspending the baffle from the open upper end 59 of stack 57.

As described, both the firebox baffle 62 and the stack baffle 67 can be readily removed for inspection or cleaning of the interior surfaces of the firebox and stack.

Figure 5:
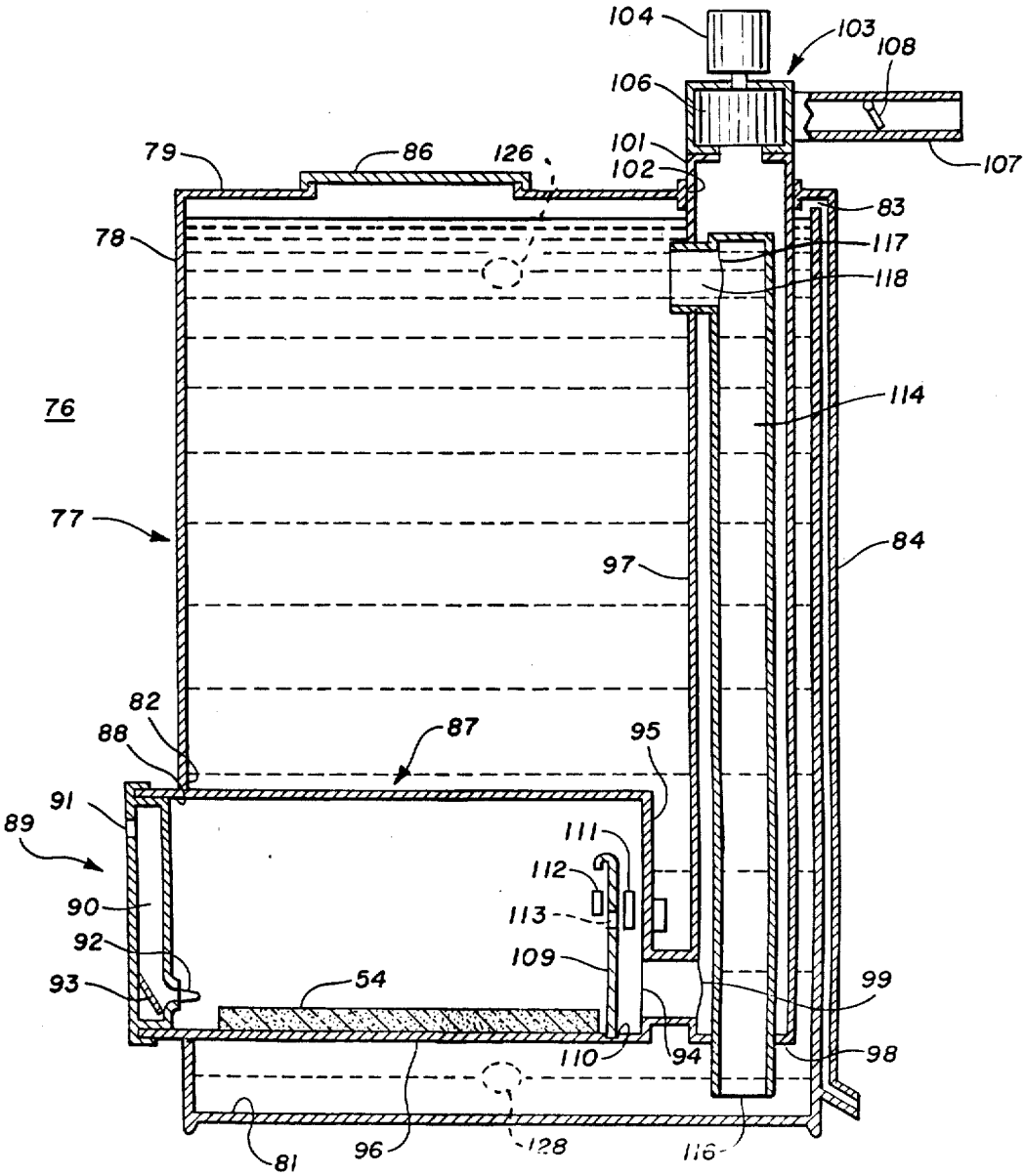
FIG. 5 is a partial sectional view similar to FIG. 2 of another embodiment of the invention.

FIG. 5 shows another preferred embodiment 76 of the present invention. In this case the storage tank 77 also has a cylindrical side wall portion 78 and top and bottom tank wall portions 79, 81. The storage tank 77 is substantially shorter vertically and somewhat wider in diameter than the corresponding tank portion of the embodiment shown in FIGS. 1 to 4. As discussed below, the same total volume of water can be handled within a substantially lower vertical clearance, such as the nine- or ten-foot headspace within a garage. For example, a unit of the type shown in FIG. 5 can have a total tank height of 103 inches and a tank diameter of 76 inches, as compared to a narrower and taller storage tank as shown in FIGS. 1 to 4, which might have a total height of 144 inches and a tank diameter of 64 inches, with essentially the same volume of liquid. Tanks of these specific dimensions have a total liquid capacity of approximately 2,000 gallons, minus the volume occupied by the firebox and stack members. Thus each storage tank has a substantial capacity for a large and heavy volume of water such as more than 1,000 gallons.

More specifically, the tank of FIGS. 1 to 4, at 231 cubic inches per gallon, has a gross capacity of 2,004 gallons. With a firebox of 30 inch diameter and 48 inch length, and a stack of 8 inch diameter and 96 inch length, the net capacity is approximately 1,833 gallons. Similarly, the tank of FIG. 5 has a gross capacity of 2,021 gallons. With a firebox of 30 inch diameter and 60 inch length, and a stack of 12 inch outer diameter, 11½ inch inner water pipe diameter and 100 inch length, as further described below, the net capacity is approximately 1,828 gallns.

The specific tank size is designed in each case to fit within the available vertical headspace and to store enough gallons of hot water to provide the desired heating needs for a period of as much as 4 to 5 days after the storage tank water has initially been brought to 212° F. and before the water temperature has dropped to a point where another load of solid fuel chunks must be burned to restore the effective heating temperature.

Cylindrical steel tanks of standard lengths from 6 feet to 8 feet and of standard diameters, such as 64 inches, 71 inches, and sometimes 83 inches are preferred, since they are commercially available at more economical costs. In most cases a gross capacity of about 1,500 gallons or a net capacity from 1,000 to 1,300 gallons can serve as a representative practical lower limit for an installation designed for small household use with reasonable intervals between the intermittent burnings of successive chunk fuel loads. Smaller capacities are operative, but require more frequent burnings with less efficient thermal storage.

Tank 77 also includes a single firebox opening 82, and an overflow and vent openings 83 at the extreme top of the tank. This vent opening 83 is connected to an overflow pipe or downspout 84, the lower end of which can direct the overflowing liquid as desired. A removable manhole cover 86 in the top wall of the tank permits desired inspection and cleaning.

The firebox 87 of this embodiment also has one open end 88 in liquid-tight engagement with the firebox opening 82 of the side wall portion. The opening has a firebox cover 89 of double-walled construction to provide an inner air space 90, with an air inlet opening 91 near the top of the door and with air outlet nozzles or openings 92 at the lower end of air space 90 to direct the incoming air at the base of the pile of solid fuel being burned in the firebox. An internal baffle 93 may also be used within air space 90 to control the direction or distribution of such air toward the fuel.

In this design, with the increased tank diameter, it is possible to provide a firebox outlet 94 in the inner end wall 95 of the firebox at a location close to the bottom wall portion 96. This opening is connected to a vertical stack member 97 which has a lower end 98 extending downwardly in the space between end wall 95 and the tank side wall. A side opening 99 in the stack is connected laterally to the firebox outlet opening 94, and the upper end 101 of the stack extends through an opening 102 in the top tank wall 79, with sufficient clearance for relative vertical expansion or contraction of the stack within such opening, as described in connection with FIGS. 1 to 4.

To obtain a forced draft for the burning fuel in this embodiment, a blower 103 with a motor 104 and fan blades 106 is mounted at the upper discharge end of the stack 97 and draws air inwardly from the firebox cover opening 91 through the firebox, up through the stack, and out through a lateral exhaust pipe 107. A back draft damper 108 may be mounted within the stack exhaust 107.

In this embodiment, a baffle member 109 is also mounted in the firebox, but is positioned vertically, so that the gaseous combustion products must move along the upper wall portion of the firebox and then downwardly between baffle 109 and end wall 95 to insure optimum heat transfer through the firebox end wall 95 before the gasses pass through the outlet 94 and into the lower end of stack 97. Vertical baffle 109 is also supported in a manner to permit its ready removal for cleaning or inspection purposes. Thus the lower end of the baffle may be located in a positioning slot 110, from which it can be disengaged by vertical upward movement. An upper limiting stop 111 defines the spacing between baffle 109 and the firebox end wall 95, and the baffle member is retained between stop 111 and inner stop 112, when the baffle is in its lower operating position. A slot or notch 113 in the baffle member permits its upper end to be removed laterally toward the firebox door, when the baffle is lifted and opening 113 is aligned with inner stop 112. Other supporting arrangements can be used which will provide the desired operating position and convenient removal.

Optimum heat transfer from stack 97 is facilitated in this embodiment by the greater vertical distance within which the stack can extend from the lower portion of the firebox to the upper tank wall. Such heat transfer is further enhanced by the provision of an inner pipe 114 (rather than a twisted baffle) within stack 97. This inner pipe 114 has an open lower end 116 to receive the somewhat cooler liquid which has been found to be present in the lower portion of the space below firebox bottom wall 96 and above bottom tank wall 81.

The upper end of inner pipe 114 has an opening 117 which is connected through a transverse tubular section 118 to the liquid near the top of the tank. Thus, as the gaseous combustion products flow upwardly through stack 97, they not only heat the stack wall itself, for increased heat transfer to the tank liquid throughout the length of the stack, but such combustion gases also sweep along the inner pipe portion 114 for further heat transfer to the liquid within that pipe. As the liquid is heated, there is a convection flow of such liquid from the bottom portion of the tank to the top, and the warmer liquid at the top of the tank, in turn, is drawn downwardly around the firebox 87 to the space below bottom wall portion 96, from which it can again circulate up through pipe 114 for further heating. The device of FIG. 5 thus provides increased efficiency of liquid heating for a given amount of solid fuel, as compared to an apparatus having the design of FIGS. 1 to 4 with a substantially equal volume of liquid and equivalent firebox size. The embodiment of FIG. 5 also has essentially the same advantages as to temperature, safety and avoidance of internal pressure buildup which have been described earlier in this specification. A hot water outlet 126 at a level below vent opening 83, and a cool water inlet 128 near the tank bottom, can circulate hot water through a space heating system.

The embodiments described can also be provided with an electrical heating element in the storage tank. One such element is shown at 121 in FIG. 1. It has external connections 122 and 123 for connection to an electric supply line through a control switch (not shown). Thus off-peak electrical standby energy can be used as needed or desired.

The use of cylindrical cross sections for the storage tank and firebox provides advantages of economy of construction with minimal need for external reinforcement and an efficient relationship of volume to external size. In the preferred embodiments known, the axis of the cylindrical storage tank is vertical, while that of the cylindrical firebox is horizontal. It may be advantageous in some cases to position the storage tank axis horizontally, with the horizontally oriented cylindrical firebox having its firebox opening in a flat vertical circular end wall of such a horizontal cylindrical tank.

For operation of the described apparatus, a load of wood, for example in the range from 75 to 150 pounds is placed in the firebox. The exact weight may depend on the kind of wood and the size of the pieces, such as logs of three to eight inch diameter. The smaller logs or chunks can be packed more tightly than a smaller number of larger-diameter logs. Such a load, when burned under forced draft from the blower means, can require from 45 minutes to one hour for complete combustion. The exact blower draft in C.F.M. (cubic feet per minute) can be adjusted to insure such complete burning and to achieve firebox internal temperatures as high as 1,600 to 2,000 degrees F. for effective transfer of heat from the firebox to the surrounding water. The actual heat energy in B.T.U.'s per minute will vary with the kind of wood, the degree of moisture of the starting fuel, and the total time of burning. The preheating of the incoming combustion air through the firebox door can heat such air to 400 degrees F. by the time it reaches the burning fuel.

Thus the apparatus provides the desired efficiency of combustion (i.e. low pollution production) and maximization of heat output for transfer to the surrounding liquid, which then serves as a thermal storage reservoir to preserve as much of the heat energy as possible for use prior to the subsequent burning of another fuel load.

Figure 6:
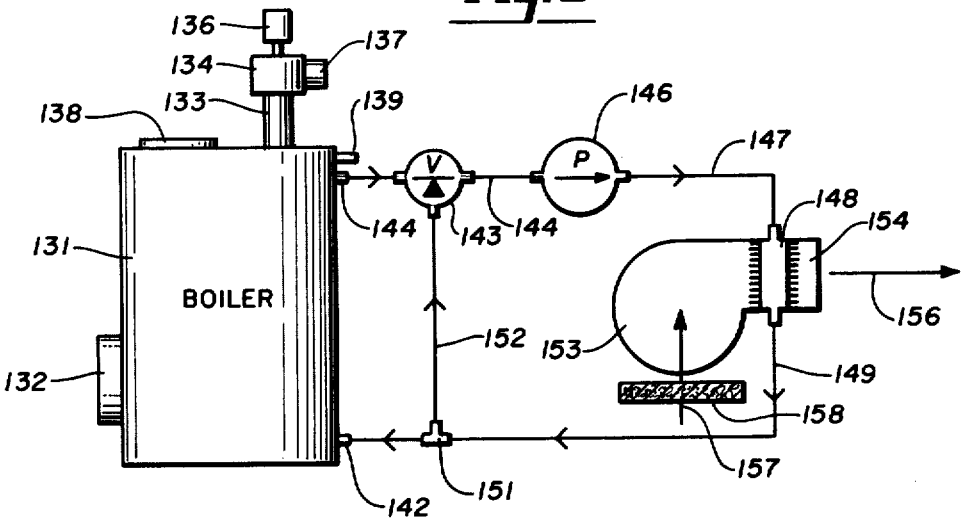
FIG. 6 is a partially schematic view showing how one of the embodiments of FIGS. 1 to 4 or FIG. 5 can be connected to a fan coil unit for a newly constructed forced air heating system.
Figure 7:
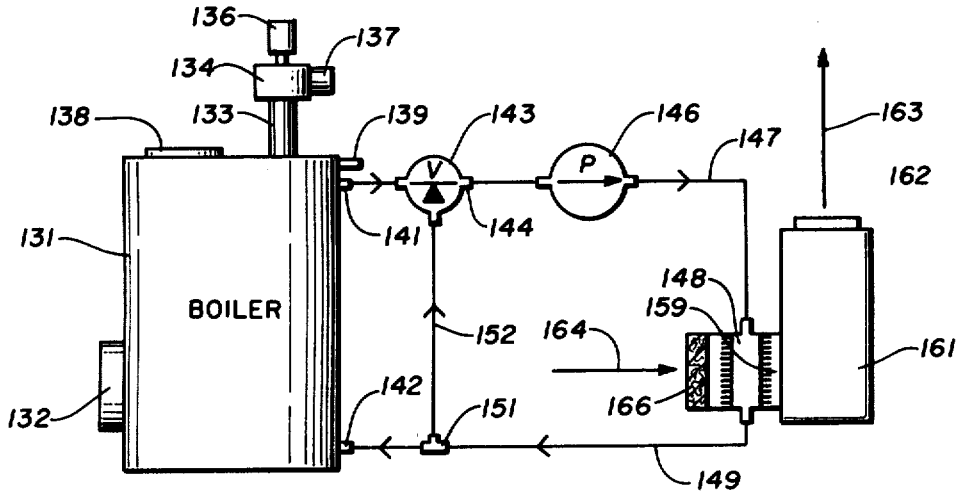
FIG. 7 is a view similar to FIG. 6 showing how one of the embodiments of FIGS. 1 to 4 or FIG. 5 can be connected as a retrofit to an existing forced air heating system.
Figure 8:
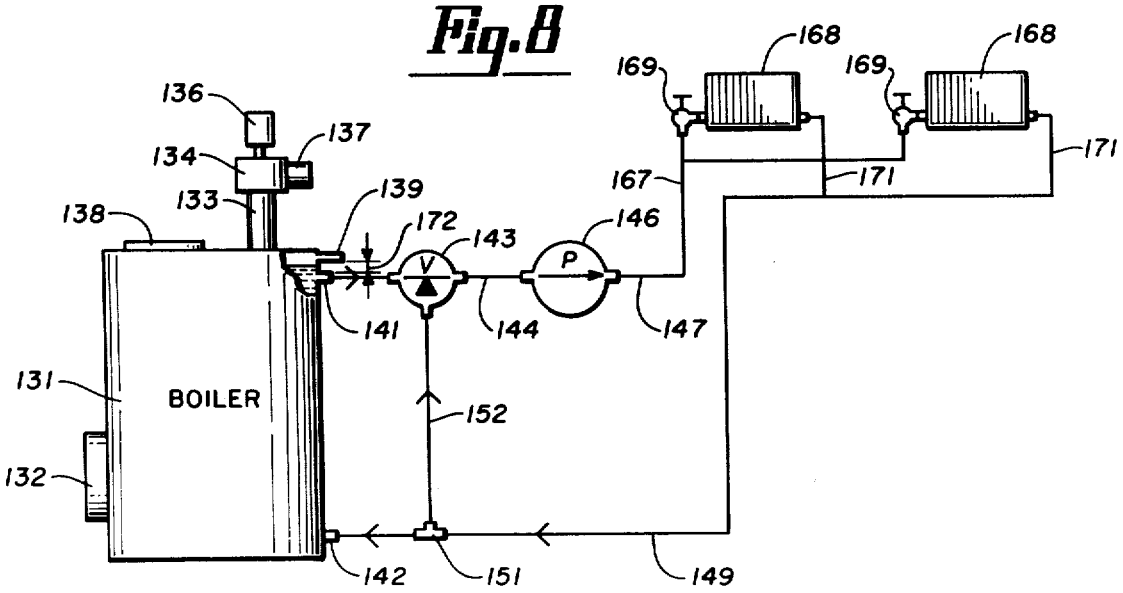
FIG. 8 is a view similar to FIGS. 6 and 7 showing how one of the embodiments of FIGS. 1 to 4 or FIG. 5 can be connected as part of a hot water radiator heating system.

FIGS. 6, 7 and 8 show some of the ways in which the embodiments of either FIGS. 1 to 4 or FIG. 5 can be coupled to forced air or hot water space heating systems for a particular room or building installation. In each case, the combination liquid heating and storage tank is shown at 131, with a firebox door at 132 and a stack member at 133. A blower 134 driven by a motor 136 discharges the gases from stack 133 through stack outlet 137, and thus establishes a forced draft of combustion air into the firebox through door 132 and out through the stack member, as previously described in connection with FIG. 5. A tank cover 138 provides access for cleaning and refilling the tank, when needed. A constantly open venting means 139 is provided at the uppermost level in the tank.

Hot water is drawn from the tank through an outlet or hot water supply line at 141, which opens into the upper portion of the tank, but at a level somewhat below the vent opening 139. A cooler water return line 142 is provided at the lower portion of the tank 131 for recirculation of cooler liquid to the tank.

The hot water supply line 141 is connected as one input to a tempering valve 143, which has an output line 144 connected to the suction end of pump 146. The output from pump 146 is fed by line 147 to the particular heating system involved, and a cooler water return line 149 brings the liquid back from such a system to a constantly open T-connection at 151, one branch of which is connected to the cool water return pipe 142, while the main stem of the T-connection is connected by pipe 152 to a second input or inlet of the tempering valve 143. Such tempering valves have long been known and used in the heating field, and their function is to supply properly the heated liquid from valve 143 to pump 146 and thence through the heating elements of the systems described and shown in the respective figures, and then back through pipe 152 for recirculation, as long as the temperature of the returning liquid in line 152 is still high enough to provide effective heating in the system to which the connections are made. During such recirculation, tempering valve 143 closes the inlet portion connected to hot water supply line 141, and uses only the recirculation of the liquid returning at 149 and 152 for further circulation by pump 146.

When the temperature of the returning liquid in line 152 drops below the desired effective heating level, however, the tempering valve begins to admit a proportional amount of hot water from supply pipe 141, at a sufficient volume rate to blend with cooler liquid in pipe 152, so hot water is drawn through pipes 144 and 147 by pump 146. When both inlets of tempering valve 143 are open in this manner, some of the cooler liquid returning in line 149, to the extent that it is not accepted by the tempering valve and drawn up through pipe 152, will be fed back through the cool liquid return pipe 142 to the bottom of tank 131.

If the returning liquid in lines 149 and 152 has reached too low a temperature to be effectively blended with a proportional amount of hot liquid from pipe 141, the tempering valve 143 can completely close the inlet to which pipe 152 is connected and thus draw liquid entirely through the hot water outlet 141 of the tank. In such a case the return flow through pipe 142 will just match and replenish the output which is drawn through outlet 141 by pump 146. If the maximum temperature of liquid available through outlet 141 has dropped to a point lower than that for which the tempering valve 143 has been set to establish effective heating in the rest of the system, then it will be necessary to restore the 212° F. water temperature in the tank 131 by burning another load of solid fuel, after which the cycle can be repeated intermittently at such intervals as are required, e.g., the four to five day intervals discussed above.

As to the respective heating systems in FIGS. 6, 7 and 8, FIG. 6 shows the circulation of the hot liquid from pipe 147 through a liquid-to-air heat exchanger 148 and back to return pipe 149. A fan coil unit or blower 153 forces air through the heat exchanger to an outlet 154 which is connected to feed hot air to the ducts of a forced air system within a house or building, as shown by the output arrow 156. The return ducts for cool air from such a system are fed as shown at arrow 157 through a suitable filter 158 and back into the inlet of the fan coil unit blower 153.

FIG. 7 also shows a connection of the hot water line 147 through a heat exchanger 148 to the return line 149. In this case the heat exchanger is adapted to discharge hot air through outlet 159 to the return air duct opening of a standard forced air furnace 161, which may be retrofitted to use its own blower (not shown) to feed the hot air from heat exchanger 148 through an outlet 162 and into the normal hot air ducts of a standard forced air heating system, as shown by arrow 163. The cold air return ducts of such a system are then connected as shown schematically by arrow 164 to return the cooler air through a filter 166 and into the heat exchanger 148 for further recirculation through the room or household system by the normal fan or blower in furnace unit 161.

FIG. 8 shows one manner in which the combination liquid heating and storage unit 131 of the present invention can be connected to a room or household hot water radiator or radiant floor system. In this case the hot water outlet pipe from pump 146 extends as a hot water line 167, which can selectively feed hot water to one or more radiators 168, depending on the setting of individual radiator valves 169. The hot water circulates through such radiators and then is fed by return lines 171 to the cooler water return line 149 already discussed. The operation of the tempering valve 143 and pump 146 can be set and controlled, as in the systems of FIGS. 6 and 7, to recirculate all or part of the returning liquid reaching the T-connection 151, or to close off entirely the tempering valve inlet from pipe 152 and recirculate only the hot water from the supply line 141, until the temperatures within the tank 131 have dropped to a point where another load of solid fuel must be burned.

As shown in FIG. 8, the hot water system includes pipes and radiators at a level higher than the hot water supply outlet 141 in tank 131. Similarly, in the forced air systems of FIGS. 6 and 7, those portions of the systems which are to circulate hot water from outlet 141 and back to return inlet 142 may include portions on a higher level, such as a floor level above that at which the storage tank is located.

As shown by the two-headed arrow 172 in FIG. 8, however, the hot water supply outlet 141 in all these systems is positioned in the upper portion of tank 131 at a level sufficiently below the constantly open vent 139 to insure that the volume of hot liquid within the large diameter storage tank 131 and located vertically below the bottom of the vent opening 139 and above the top of the hot water outlet opening for pipe 141 will initially include more than enough capacity of hot liquid in gallons to initially fill all portions of each of these systems, when pump 146 draws hot liquid from the tank outlet 141 to fill the system, without reducing the liquid level in tank 131 to a point where air could enter the hot water outlet 141. Thus, if there is any air leakage in the upper portions of the hot water portions of any such system, for example at radiators 168 or valves 169, in FIG. 8, or in any higher hot water portions of a FIG. 6 or 7 type of system, the capacity of the storage tank portion measured vertically by the two-headed arrow 172, will be adequate to provide the necessary water to fill such systems and/or receive whatever water might return from the upper portions of such a system into the tank, if there is any air leakage into higher portions of the system when the pump 146 is stopped.

Thus the systems of FIGS. 6 to 8 can operate with the top of storage tank 131 at ambient atmospheric pressure, with pump 146 forcing the water to a higher level as needed, and without having a problem of liquid overflow due to possible boiling or flashing into steam of water in the upper portions of such a system, where a static pressure less than the atmospheric pressure at the lower level of the open vent 139 could be involved.

In a tank of the diameter mentioned for FIG. 5, the water volume is about 18 gallons per inch of height. Thus only 3 inches of water in the tank will supply the 50 gallons required for a typical hot water system with radiators and pipes as in FIG. 8. The tank of FIGS. 1 to 4 would require approximately 4 inches to supply or receive a similar number of gallons. Heat exchangers forced air systems as in FIGS. 6 and 7 require even smaller quantities of water. As a practical matter, a normal difference of 16 inches vertically between vent 139 and hot water outlet 141 is preferred as a standard factor for most installations.

Thus the exemplary systems of FIGS. 6 to 8 all have the safety advantages of operation at ambient pressure and 212° F. maximum water temperature within the unit 131 without the necessity of building up the pressures of 15 to 30 p.s.i. above atmospheric pressure which are normally needed, for example, in a closed hot water heating system designed for heating room or building spaces by feeding hot water to levels above the usual boiler unit.

The invention described herein accordingly provides an improved liquid heating and storage apparatus for efficient and safe use with wood, coal and other solid or chunk-type fuels. The combination of a solid-fuel burning firebox essentially fully immersed within a tank of adequate capacity to store the desired quantity of liquid to be heated offers advantages of efficient utilization of the heat from such fuel and the safety of the apparatus and its operators and adjacent structures.

The foregoing specification sets forth certain preferred embodiments and modifications of the invention and some of the ways in which the invention may be put into practice, including the best mode presently contemplated by the inventor for carrying out this invention. Modifications of the described embodiments, as well as alternate embodiments and devices for carrying out the invention, may also be apparent to those skilled in the art, within the spirit and scope of the following claims:

I claim:

1. A combination solid-fuel-burning liquid heating and thermal energy storage apparatus for storing heated liquid for the heating of room spaces and other uses during intervals between intermittent burnings of successive fuel loads, said apparatus comprising a storage tank of substantial capacity having top, bottom, and side tank wall portions for containing a large volume of liquid to be heated and stored between such intermittent burnings, the side wall portion having a single firebox opening therein spaced above the bottom tank wall portion, a liquid-tight firebox within said tank having one open end in liquid-tight engagement with the tank wall portion around the firebox opening and having a main body portion with top, bottom and side firebox wall portions and a firebox end wall portion opposite the open end, means supporting the firebox at a level within the tank for substantially complete immersion of the firebox top, bottom, side and opposite end wall portions, at all times during such intermittent burnings, within the liquid to be heated and stored within the tank, means constantly venting the top of said storage tank to ambient pressure outside the tank, an open stack member extending from the firebox through the expected liquid in the tank, said stack member having an inlet opening communicating with the interior of the firebox, an outlet opening outside of the tank for discharging gaseous combustion products from the firebox, and an intermediate portion extending through the liquid in said tank, one tank wall portion having an outlet opening for the stack member with the stack member extending outwardly through said opening, the stack member and wall portion having means permitting expansion and contraction of the stack member blower means for providing a draft of combustion air into the firebox opening and a forced discharge of the gaseous combustion products from the firebox and through said stack throughout the burning of each intermittent fuel load thereby minimizing incomplete combustion of such fuel and the deposit of solid fuel residues within the firebox and stack, and heat transfer means including at least a hot liquid outlet connection to said tank for transferring stored thermal energy from the heated liquid in the tank for the heating of said room spaces and other uses.

2. A combination solid-fuel burning liquid heating and thermal storage apparatus for storing heated liquid for the heating of room spaces and other uses during intervals between intermittent burnings of successive fuel loads, said apparatus comprising a storage tank of substantial capacity, such as more than 1,000 gallons, having top, bottom, and side tank wall portions for containing a large volume of liquid to be heated and stored, the side wall portion having a single firebox opening therein spaced above the bottom tank wall portion, a liquid-tight firebox fixed within said tank and having one open end in liquid-tight engagement with the tank wall portion around the firebox opening and having a main body portion with top, bottom and side firebox wall portions and a firebox end wall portion opposite the open end, means supporting the firebox at a level close to but above the bottom tank wall portion within the tank for substantially complete immersion of said firebox top, bottom, side and opposite end wall portions within the liquid for efficient heat transfer to bring the liquid to room heating temperatures for use between such intermittent burnings, said tank having an inlet connection at a lower portion of the tank and an outlet connection positioned near the top of the tank, means constantly venting the top of said storage tank to ambient pressure outside the tank and thereby holding the maximum tank liquid temperature close to the liquid boiling point at such ambient pressure and preventing increases of the internal tank pressure and external tank temperatures above safe levels with respect to any immediately adjacent building walls, a stack member extending through the liquid, said stack member having an inlet opening communicating with the interior of the firebox and an outlet opening outside of the tank for discharging gaseous combustion products from the firebox, a firebox door member for selectively opening and closing said firebox opening, and blower means connected to said stack member for drawing a supply of combustion air into the firebox opening and firebox and providing a forced discharge of the gaseous combustion products out through said stack during the burning of each successive fuel load and thereby minimizing incomplete combustion of such solid fuel and the deposit of undesired solid fuel residues within the firebox and stack.

3. Apparatus according to claim 2 in which the stack has a construction and location providing heat transfer enhancing means for increasing the effective heat transfer from the gaseous combustion products in the stack to the liquid in such tank, before the gaseous combustion products are discharged from the stack.

4. Apparatus according to claim 3 in which said heat transfer enhancing means includes a spiral baffle member extending upwardly through the stack and directing combustion gases laterally against the inside of the stack for thermal transfer to liquid around the stack.

5. Apparatus according to claim 3 in which the firebox end wall portion has an outlet opening close to its bottom wall portion, and the stack member extends vertically alongside the firebox end wall portion and through the top tank wall, with the stack inlet opening close to and at the general level of the firebox outlet opening.

6. Apparatus according to claim 5 in which the stack member has a cylindrical wall portion of circular cross section and includes a concentric inner liquid-carrying pipe defining an annular flue between the stack wall and pipe, said pipe having an inlet opening at its lower end at a level lower than the bottom firebox wall portion and also having an outlet opening at its upper end connected to discharge heated liquid from the pipe into the tank at a level close to the top tank wall portion.

7. Apparatus according to claim 5 in which the firebox has its outlet opening in the firebox end wall portion opposite the firebox opening, the firebox also having a vertical baffle plate parallel to said opposite end wall, said baffle plate extending upwardly from the firebox bottom wall portion and directing combustion gases against the firebox top and opposite end wall portions before such gases enter the firebox outlet opening.

8. Apparatus according to claim 2 in which said opposite firebox end wall portion is spaced inwardly from the tank side wall portion and the stack member extends upwardly in the space between said opposite firebox end wall portion and tank side wall portion.

9. Apparatus according to claim 2 in which the storage tank also has a stand-by electric heating element therein.

10. Apparatus according to claim 9 in which the electric heating element has external connections for selective use of off-peak electrical stand-by energy.

11. Apparatus according to claim 2 in which the storage tank side walls are cylindrical.

12. Apparatus according to claim 11 in which the firebox is cylindrical.

13. Apparatus according to claim 12 in which the storage tank sidewalls are cylindrical about a vertical axis and the firebox is cylindrical about a horizontal axis.

14. Apparatus according to claim 2 in which said firebox door has means for preheating the forced draft supply of combustion air and feeding it into the firebox.

15. Apparatus according to claim 14 in which the firebox door member has an upper wall portion adapted to extend transversely across the full interior cross section of the firebox opening and an outer cover wall portion spaced outwardly from the inner wall portion and extending fully across the firebox opening, said inner and outer cover wall portions defining an enclosed air chamber extending fully across the firebox opening and minimizing the transfer of heat from such firebox to the outer cover wall portion, said outer cover wall portion having an air inlet opening at an upper location in the transverse cross section of the air chamber, and said inner wall portion having an air discharge opening at a lower location in the transverse cross section of the air chamber for drawing combustion air across said air chamber and inner wall portion and discharging such combustion air into the firebox opening and toward the base of a pile of solid fuel chunks normally positioned in the firebox, thereby preheating the combustion air by contact with the inner wall portion before it is discharged into the firebox.

16. Apparatus according to claim 2 in which the top tank wall portion has an opening for the stack member and the stack member extends upwardly through said top wall opening, the stack member having sufficient clearance within the opening for relative vertical expansion and contraction of the stack member within the opening.

17. Apparatus according to claim 2 in which the outlet connection near the top of the tank is positioned at a level spaced below the level of the means constantly venting the top of the tank by a vertical tank space which provides storage for as much as fifty gallons of liquid in the tank between such outlet and venting levels.

18. Apparatus according to claim 17 in which the vertical tank space between such outlet and inlet levels is substantially sixteen inches.

19. Apparatus according to claim 2 in which the tank outlet connection is connected to supply hot water for circulation to a space heating system for a room or building installation, and in which the tank inlet connection is connected to receive cooler water returning from such space heating system.

20. Apparatus according to claim 19 having a pump with an inlet and outlet, a tempering valve with two inlets and an outlet, a cooler water return line having a return branch connection receiving at least part of the cooler water returning from the space heating system, the tempering valve having one of its inlets connected to the tank hot water outlet, its other inlet connected to the cooler water return branch connection, and its outlet connected to the pump inlet, the pump outlet being connected to deliver hot water from the tempering valve for the space heating system, and the tank inlet connection being also connected to the cool water return line.

21. Apparatus according to claim 20 in which the space heating system includes a liquid-to-air heat exchanger, warm air heating ducts from the heat exchanger to the space to be heated, and fan means for feeding air from the heat exchanger through the warm air ducts, and in which the pump outlet is connected to feed hot water to the heat exchanger, and the tank inlet connection and return branch connection are connected to receive cooler water from the heat exchanger.

22. Apparatus according to claim 20 in which the space heating system includes a hot water heating radiator unit with a hot water supply pipe and a water return pipe, and in which the pump outlet is connected to the radiator unit supply pipe and the radiator unit water return pipe is connected to both the tank inlet connection and the return branch connection.

23. Apparatus according to claim 20 in which at least some of the water containing portions of the space heating system are at a level above the level of the constantly open venting means of the storage tank, and in which the hot water outlet connection near the top of the tank is positioned at a level spaced below such venting means by a vertical tank distance which provides storage space in the tank between such outlet and venting levels for at least as much water as is circulated by said pump to levels above the level of the tank venting means.

* * * * *